US010676328B2

(12) United States Patent
Benton et al.

(10) Patent No.: US 10,676,328 B2
(45) Date of Patent: Jun. 9, 2020

(54) CRANE FUNCTION PERFORMANCE ENHANCEMENT FOR NON-SYMMETRICAL OUTRIGGER ARRANGEMENTS

(71) Applicant: Manitowoc Crane Companies, LLC, Manitowoc, WI (US)

(72) Inventors: John F. Benton, Smithsburg, MD (US); Stephen J. Schoonmaker, Chambersburg, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 0 days.

(21) Appl. No.: 15/680,971

(22) Filed: Aug. 18, 2017

(65) Prior Publication Data

US 2018/0057318 A1 Mar. 1, 2018

Related U.S. Application Data

(60) Provisional application No. 62/378,987, filed on Aug. 24, 2016.

(51) Int. Cl.

| | |
|---|---|
| ***B66C 13/08*** | (2006.01) |
| ***B66C 23/90*** | (2006.01) |
| ***B66C 13/06*** | (2006.01) |
| ***B66C 13/46*** | (2006.01) |
| ***B66C 13/48*** | (2006.01) |
| ***B66C 15/04*** | (2006.01) |

(52) U.S. Cl.

CPC ..... *B66C 13/085* (2013.01); *B66C 13/063* (2013.01); *B66C 13/46* (2013.01); *B66C 23/905* (2013.01); *B66C 13/48* (2013.01); *B66C 15/045* (2013.01)

(58) Field of Classification Search

CPC ..... B66C 13/085; B66C 13/063; B66C 13/46; B66C 13/48; B66C 23/905; B66C 15/045

USPC ..... 701/5

See application file for complete search history.

(56) References Cited

U.S. PATENT DOCUMENTS

2013/0013251 A1* 1/2013 Schoonmaker ..... B66C 13/46 702/152

2016/0176686 A1* 6/2016 Schoonmaker ..... B66C 15/045 701/50

(Continued)

FOREIGN PATENT DOCUMENTS

DE 102014105618 A1 10/2015

EP 0382231 A1 8/1990

(Continued)

OTHER PUBLICATIONS

Extended European Search Report issued by EPO in connection with EP17187388 dated Mar. 8, 2018.

*Primary Examiner* — Lail A Kleinman

*Assistant Examiner* — Mahmoud M Kazimi

(74) *Attorney, Agent, or Firm* — Levenfeld Pearlstein, LLC

(57) ABSTRACT

A method for controlling a boom of a crane includes saving, in a memory, data representing a maximum horizontal working distance for a load on a hook of a boom, saving, in the memory, boom data representing the position of the boom, calculating a minimum vector between the position of the hook and the maximum horizontal working distance, and controlling, by the computing device, movement of the boom to prevent the vector from reaching a zero magnitude.

20 Claims, 6 Drawing Sheets

(56) References Cited

U.S. PATENT DOCUMENTS

| | | | | |
|---|---|---|---|---|
| 2017/0036894 | A1* | 2/2017 | Braun | B66C 23/36 |
| 2019/0062130 | A1* | 2/2019 | Benton | B66C 13/16 |

FOREIGN PATENT DOCUMENTS

| | | | |
|---|---|---|---|
| EP | 3037376 | A1 | 6/2016 |
| WO | 2013006625 | A2 | 1/2013 |

* cited by examiner

CRANE FUNCTION PERFORMANCE ENHANCEMENT FOR NON-SYMMETRICAL OUTRIGGER ARRANGEMENTS

BACKGROUND

The present disclosure relates to crane control systems and more particularly to a Rated Capacity Limiter (RCL) of a crane with a non-symmetrical outrigger arrangement.

Mobile cranes typically include a carrier unit in the form of a transport chassis and a superstructure unit having a boom for lifting objects. The superstructure unit is typically rotatable upon the carrier unit. In transport the crane is supported by the carrier unit on its axles and tires.

When used for lifting operations, the crane should normally be stabilized to a greater degree than is possible while resting on the tires and axles of the transport chassis. In order to provide stability and support of the crane during lifting operations, it is well known to provide the carrier unit with an outrigger system. An outrigger system will normally include at least two (often four or more) telescoping outrigger beams with inverted jacks for supporting the crane when the crane is located in a position at which it will perform lifting tasks.

RCL systems have been developed to monitor the load the crane is lifting and alert the operator of unsafe operating conditions. Traditional RCL systems may be as simple as an indicator or audible alarm that sounds if a threshold is reached. For example, if the crane attempts to lift beyond a certain capacity, the alarm will sound. More recently, monitoring systems monitor the geometry of the crane and can alert the operator if the crane is moving into an unsafe operating condition. For example, a crane may have a constant load on the hook, but as it lowers the boom angle, the load moment increases. RCL systems may detect the change in boom angle and increase in load moment and alert the operator.

RCL systems typically have information referred to as load charts which indicate the maximum permissible load to lift depending on the crane configuration. One of the configuration characteristics is the positioning of the outriggers. Typically, there are four outriggers in a nearly square arrangement and the load charts only consider that the outriggers are extended from the vehicle at 0%, 50%, or 100%. Furthermore, the load charts assume that all the outriggers are extended to the same extent. Because the center-line of rotation is at approximately midway between the outriggers, the load chart can be assumed to be a "360 chart" since the minimum permissible load does not change with swing angle.

In some situations, a mobile crane may not be able to extend all of the outriggers to the same position. For example, a wall or other object may obstruct a single outrigger from extending, resulting in a non-symmetrical arrangement. The permissible load then becomes dependent on the swing angle. A cautious approach would be to select a load chart based on the minimum outrigger extension. This will provide a safe operating condition regardless of the swing angle. However, this load chart approach may restrict capacity of the crane that could be utilized. Alternatively, a load chart could be selected based on the position of the outriggers between the superstructure and the load. This would maximize the lifting capacity of the crane, but would require careful monitoring to ensure that the system did not do any lifting outside of a limited area.

It would be beneficial to develop a system that allows a mobile crane to perform lifting operations with a non-symmetric outrigger configuration. Furthermore, it would be beneficial if such a system did not unnecessarily limit the capacity of the crane or the swing angle of the superstructure.

SUMMARY

Systems and methods for enhancing the control of a boom of a crane when outriggers are non-symmetrical are disclosed. In one aspect, a method for controlling a boom of a crane includes saving data representing a maximum horizontal working distance for a load on a hook of a boom, saving boom data representing the position of the boom, calculating a minimum vector between the position of the hook and the maximum horizontal working distance, and controlling or limiting movement of the boom to prevent the vector from reaching a zero magnitude.

In some embodiments, saving data representing a maximum horizontal working distance includes inputting data representing a load chart. In some embodiments, the maximum horizontal working distance varies depending on a swing angle. In some embodiments, saving data representing a maximum horizontal working distance includes detecting a load on the hook and calculating a maximum working radius based on the detected load. In some embodiments, calculating a maximum working radius includes detecting a position of at least one outrigger and using the detected position to calculate the maximum working distance.

In some embodiments, the method further includes saving data representing a forbidden zone near the crane, calculating a second, minimum vector between the forbidden zone and the boom, and limiting, by the computing device, movement of the boom to prevent the second vector from reaching a zero magnitude. In some embodiments, limiting movement of the boom includes establishing a threshold vector magnitude, changing a crane function responsive to the magnitude of the minimum vector between the hook and the working radius being less than the threshold vector magnitude. In some embodiments, changing the crane function comprises slowing down the movement of the boom in at least one direction that moves the hook closer to the working radius. In some embodiments, limiting movement of the boom further includes establishing a shutdown threshold vector magnitude, and stopping movement of the boom in response to the magnitude of the minimum vector between the hook and the working radius being less than the threshold vector magnitude.

In another aspect, a system for controlling a boom of a crane is disclosed. The system includes a crane control system configured to control operation of a crane boom, a processor in operable communication with the crane control system, and memory in operable communication with the processor. The memory stores data including data representing a coordinate system, data representing the crane boom, data representing a maximum horizontal working distance, and computer executable instructions for execution by the processor. The computer executable instruction are configured to cause the processor to calculate a minimum vector between the crane boom and the maximum horizontal working distance based on the data representing the crane boom and the data representing the maximum horizontal working distance, and to cause the crane control system to limit movement of the boom based on the calculated minimum distance.

In some embodiments, the data representing the maximum horizontal working distance is dependent on a swing angle.

In some embodiments, the system further includes a load sensor configured to measure a load on the crane boom, wherein the data representing a maximum horizontal working distance is dependent on a measured load on the hook.

The system may further include an outrigger length monitor, wherein a detected outrigger length is used to calculate the maximum horizontal working distance.

According to another aspect, a crane control system includes a processor, a display operably coupled to the processor and a memory in operable communication with the processor. The memory stores data comprising data representing a coordinate system, data representing the crane boom, data representing a maximum horizontal working distance and computer executable instructions for execution by the processor, the computer executable instruction configured to generate a three dimensional model. The three dimensional model may include a representation of the coordinate system based on the data representing the coordinate system, a representation of boom based on the data representing the crane boom and a representation of the maximum horizontal working distance based on the data representing the maximum horizontal working distance. The three dimensional model is displayed on the display.

These and other features and advantages of the present invention will be apparent from the following detailed description, in conjunction with the appended claims.

DETAILED DESCRIPTION

The present embodiments will now be further described. In the following passages, different aspects of the embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
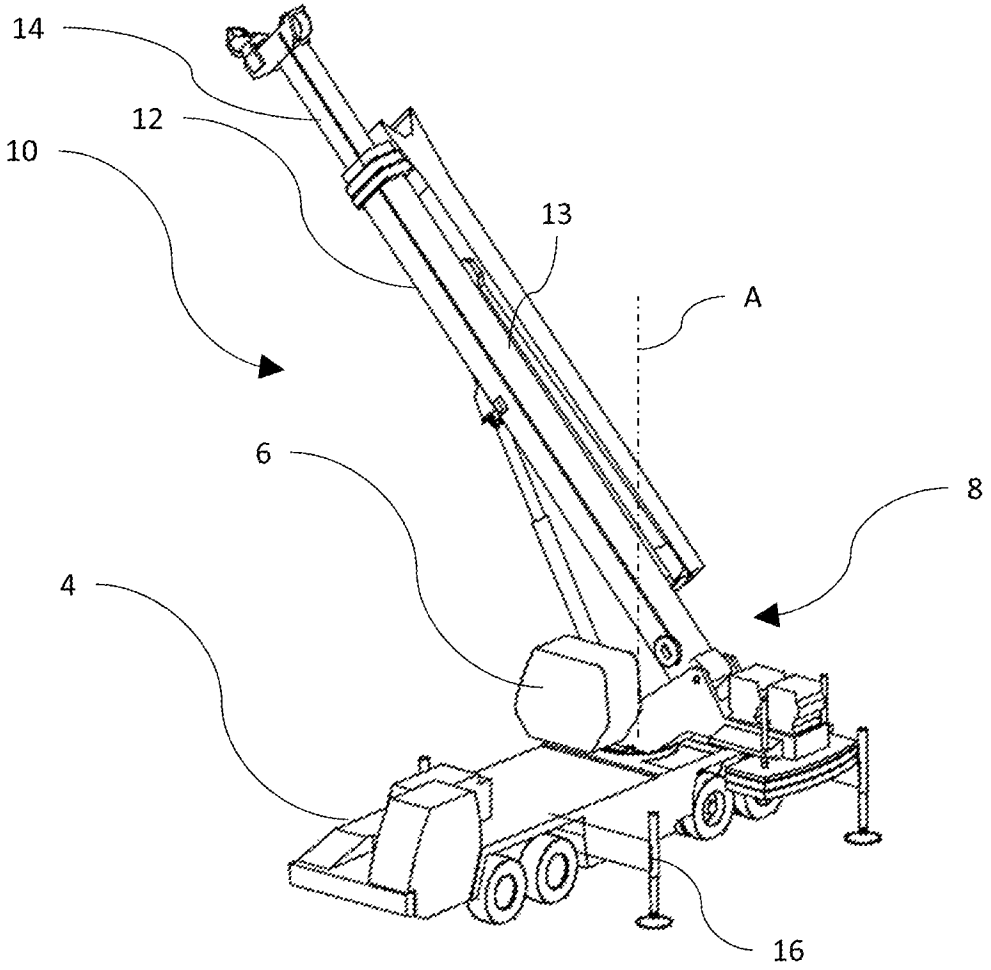
FIG. 1 illustrates a perspective view of a crane according to an embodiment.

FIG. 1 is a perspective view of a crane 10. The crane 10 includes a lower works 4 for engagement with the ground, and a cab 6 attached to a rotating bed 8, also referred to as upper works. The rotating bed 8 rotates about an axis of rotation 'A' relative to the lower works 4. A boom 12 is attached to the rotating bed 8 and is controlled by a computing device, such as a computer system (300 in FIG. 2) located in the cab 6, and by crane controllers controlled by the computing device. In one embodiment, the computer system 300 is a crane control system configured to control one or more crane functions, such as boom movement, outrigger extension/retraction, hoist operation and the like. The boom 12 may include a base portion 13 and one or more telescoping portions 14 that may be extended (tele-out) or retracted (tele-in) relative to the base portion 13 by operator controls within the cab 6 and/or a control signal received from the crane control system 300. The use of the cab 6 and the location of the computing device is merely exemplary and a computing device need not be located within the cab 6. For example, the computing device could be integrated in to the lower works of the crane 10.

The computing device 300 and controls may also control the movement of the rotating bed 8, which causes the boom 12 to swing left and swing right. The computing device and controls may also control the boom 12 to move up (boom-up) and move down (boom-down). These six directions (tele-out; tele-in; boom-up; boom-down; swing left; and swing right) may each be represented by a vector, each of which may be processed and tracked using appropriate algorithms as will be explained. Impact with obstacles on a worksite may be avoided by conducting vector analysis and continual monitoring of the orientation of the boom 12.

Outriggers 16 extend from the side of the lower works 4 and provide a base of support for the crane 10 when a lifting operation is being performed. The outriggers 16 are retracted for transportation of the crane. The outriggers are independently controlled, such that each outrigger 16 may be extended to a different distance. For example, in the embodiment of FIG. 1, the outriggers on the left hand side of the crane are extended, while outriggers on the right hand side of the crane are retracted. The extension or length of an outrigger 16 may be detected, calculated or measured, for example, by an outrigger length monitor, which may be operably connected to a computer system 300.

Figure 2:
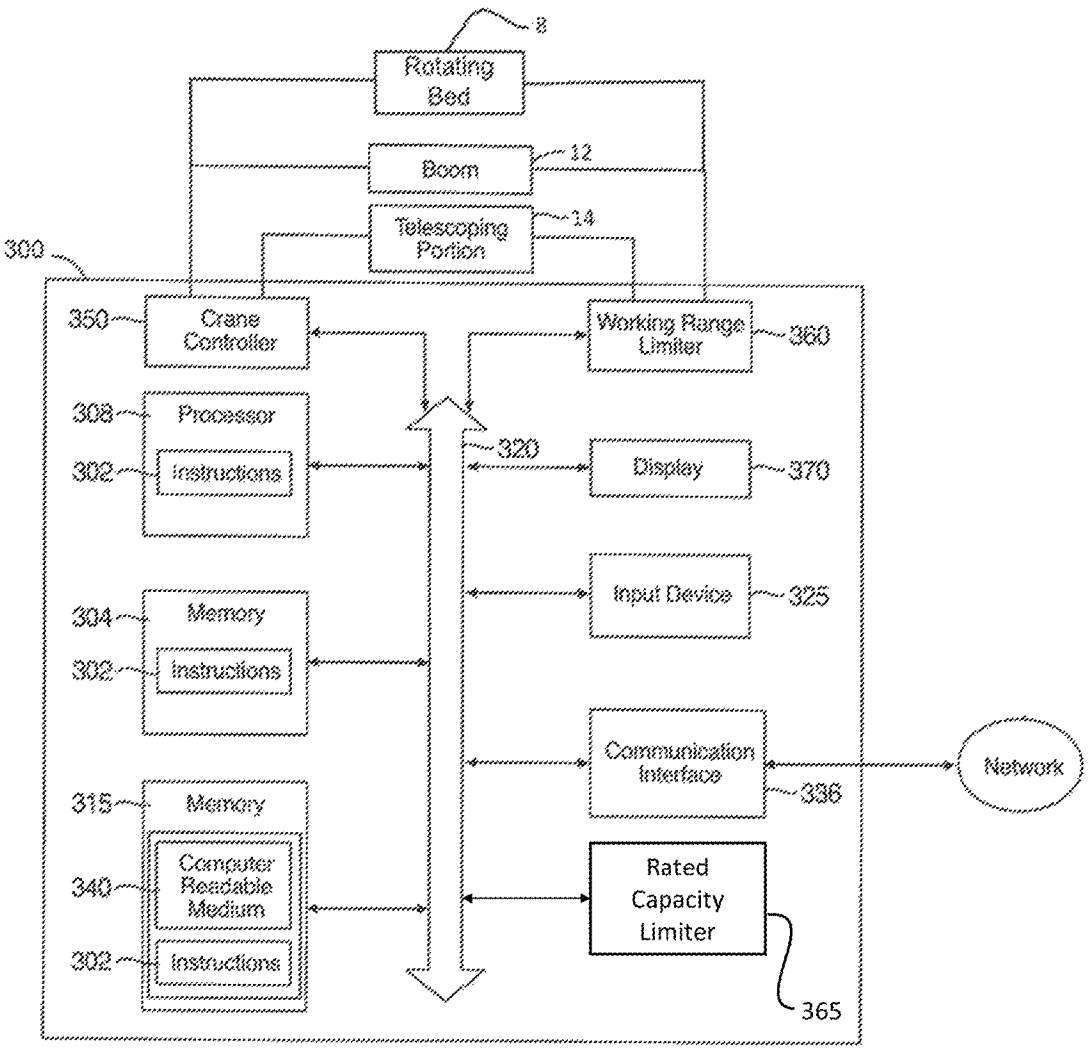
FIG. 2 illustrates a schematic or block diagram of a crane control system according to an embodiment.

FIG. 2 illustrates an embodiment of the computer system 300 (or other computing device), which may represent a cab computing device 300 or a wireless network computer, or any other computing device referenced herein or that may be used to execute the disclosed methods or logic disclosed. The computer system 300 may include an ordered listing or a set of instructions 302 that may be executed to cause the computer system 300 to perform any one or more of the methods or computer-based functions disclosed herein. The computer system 300 may operate as a stand-alone device or may be connected, e.g., using a network, to other computer systems or peripheral devices, for example.

In a networked deployment, the computer system 300 may operate in the capacity of a server or as a client-user computer in a server-client user network environment, or as a peer computer system in a peer-to-peer (or distributed) network environment. The computer system 300 may also be implemented as or incorporated into various devices, such as a personal computer or a mobile computing device capable of executing a set of instructions 302 that specify actions to be taken by that machine, including and not limited to, execution of certain applications, programs, and with the option of accessing the Internet or Web through any form of browser. Further, each of the systems described may include any collection of sub-systems that individually or jointly execute a set, or multiple sets, of instructions to perform one or more computer functions.

The computer system 300 may include a memory 304 on a bus 320 for communicating information. Code operable to cause the computer system to perform any of the acts or operations described herein may be stored in the memory 304. The memory 304 may be a random-access memory, read-only memory, programmable memory, hard disk drive or any other type of volatile or non-volatile memory or storage device.

The computer system 300 may include a processor 308, such as a central processing unit (CPU) and/or a graphics-processing unit (GPU). The processor 308 may include one or more general processors, digital signal processors, application specific integrated circuits, field programmable gate arrays, digital circuits, optical circuits, analog circuits, combinations thereof, or other now known or later-developed devices for analyzing and processing data. The processor 308 may implement the set of instructions 302 or other software program, such as manually programmed or computer-generated code for implementing logical functions. The logical function or any system element described may, among other functions, process and/or convert an analog data source such as an analog electrical, audio, or video signal, or a combination thereof, to a digital data source for audio-visual purposes or other digital processing purposes such as for compatibility of computer processing.

The computer system 300 may also include a disk or optical drive unit 315. The disk drive unit 315 may include a computer-readable medium 340 in which one or more sets of instructions 302, e.g., software, can be embedded. Further, the instructions 302 may perform one or more of the operations as described herein. The instructions 302 may reside completely, or at least partially, within the memory 304 and/or within the processor 308 during execution by the computer system 300. One or more databases in memory may store load chart data.

The memory 304 and the processor 308 also may include computer-readable media as discussed above. A "computer-readable medium," "computer-readable storage medium," "machine readable medium," "propagated-signal medium," and/or "signal-bearing medium" may include any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium.

The computer system 300 may further include a crane controller 350, a working range limiter 360, and a rated capacity limiter 365. The crane controller 350 may be coupled with the processor 308 and the bus 320 and be configured to control components of the crane, including the boom 12 and the rotating bed 8, in response to receiving control signals from the processor 308.

The rated capacity limiter 365 (also referred to as a moment limiter in the art) provides information for crane operators to ensure that the crane devices work safely in the range of design parameters. The working range limiter 360 provides information for crane operators to ensure that the crane devices work safely outside of a restricted volume. The working range limiter 360 and the rated capacity limiter 365 may each monitor the operations of the crane through a plurality of sensors, and provide information regarding the limits of the crane 10 to an operator. In some embodiments the functionality of the working range limiter 360 and the rated capacity limiter 365 may be combined into a single unit. When the crane 10 lifts objects, the reading changes continuously with the operation of the crane 10. The sensors provide information on the length and angle of the crane boom 10, the lifting height and range, the rated load, the lifted load, and so on. If the crane 10 works nearly beyond the permitted scope, the rated capacity limiter 365 and/or the working range limiter 360 may sound an alarm, may light an indicator, or modify the operation of the crane. In some embodiments, the working range limiter 360 may also be adapted to act as a controller of the boom 12, the telescoping portion 14, and the rotating body 8.

Additionally, the computer system 300 may include an input device 325, such as a keyboard, touch screen display and/or mouse, configured for a user to interact with any of the components of the computer system 300. It may further include a display 370, such as a liquid crystal display (LCD), a cathode ray tube (CRT), light emitting diode (LED) display, organic light emitting diode (OLED), or any other display suitable for conveying information. The display 370 may act as an interface for the user to see the functioning of the processor 308, or specifically as an interface with the software stored in the memory 304 or the drive unit 315.

The computer system 300 may include a communication interface 336 that enables communications via the communications network. The network may include wired networks, wireless networks, or combinations thereof. The communication interface 336 network may enable communications via any number of communication standards, such as 802.11, 802.17, 802.20, WiMax, cellular telephone standards, or other communication standards.

Accordingly, the method and system may be realized in hardware, software, or a combination of hardware and software. The method and system may be realized in a centralized fashion in at least one computer system or in a distributed fashion where different elements are spread across several interconnected computer systems. A typical combination of hardware and software may be a general-purpose computer system with a computer program that, when being loaded and executed, controls the computer system such that it carries out the methods described herein. Such a programmed computer may be considered a special-purpose computer, and be specially adapted for placement within the cab 6 and control of the crane 10.

The method and system may also be embedded in a computer program product, which includes all the features enabling the implementation of the operations described herein and which, when loaded in a computer system, is able to carry out these operations. Computer program in the present context means any expression, in any language, code or notation, of a set of instructions intended to cause a system having an information processing capability to perform a particular function, either directly or after either or both of the following: a) conversion to another language, code or notation; b) reproduction in a different material form.

The order of the steps or actions of the methods described in connection with the disclosed embodiments may be changed as would be apparent to those skilled in the art. Thus, any order appearing in the Figures or described with reference to the Figures or in the Detailed Description is for illustrative purposes only and is not meant to imply a required order, except where explicitly required.

Figure 3:
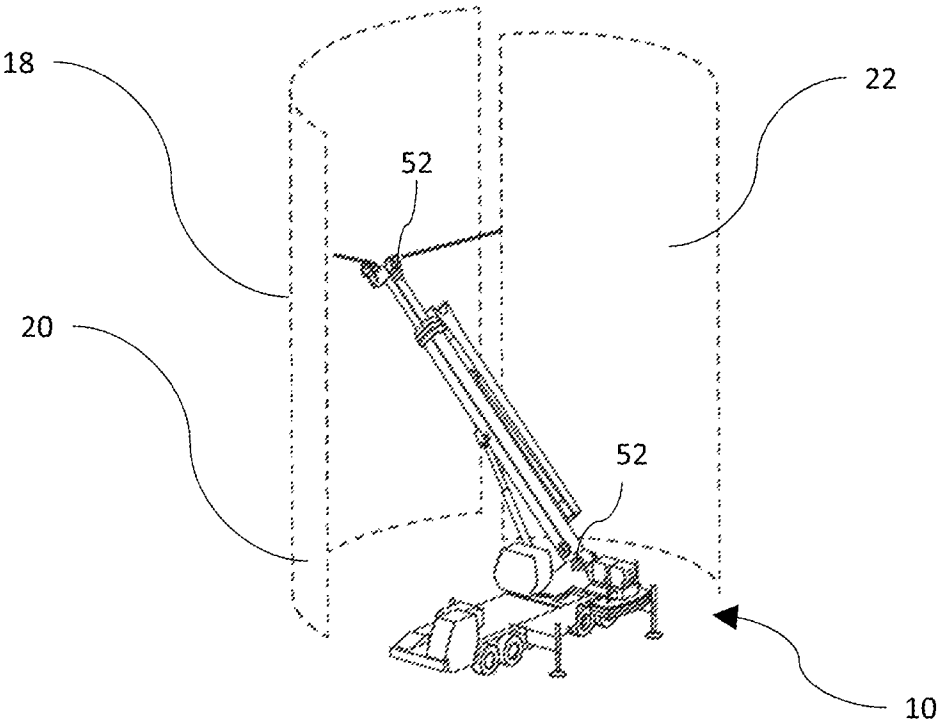
FIG. 3 illustrates a crane and a maximum horizontal working distance surface according to an embodiment.

FIG. 3 illustrates the crane 10 of FIG. 1 in relation to a three dimensional ("3D") surface 18 representing a maximum horizontal working distance which will be explained in more detail. The maximum horizontal working distance is the maximum horizontal distance from the crane 10 that a given load may be supported while maintaining a desired level of stability for the crane 10. Movement of a load beyond this maximum horizontal distance may result in an undesirable configuration.

In one embodiment, the 3D surface 18 may generally be formed by an arc extending through an angular range and having a center point generally corresponding to the axis of rotation 'A' of the bed 8. The arc represents the maximum horizontal working distance. The 3D surface 18 may further be formed by extending the arc vertically. The 3D surface 18 may thus be shown as a section of a cylindrical wall or surface, or another curved plane. In one embodiment, a vertical component of the 3D surface 18 extends perpendicular to a horizontal plane 'H' (see FIG. 4), such that part or all of the 3D surface 18 is perpendicular to the horizontal plane 'H'. Accordingly, at a given swing angle, the maximum horizontal working distance corresponds to a radius of the arc. The radius, or maximum horizontal working distance, may change as a function of the swing angle.

In one embodiment, the maximum horizontal working distance may be based on a load chart correlating a maximum load with a maximum horizontal working distance. For instance, if an operator knows that they will need to lift a specific maximum load, the operator may select a load chart specifying a maximum horizontal working distance for that load. In one embodiment, data representing the load chart may be provided to the control system 300. This is related, but different from a conventional load chart in which a maximum load is specified for a working distance. The maximum horizontal working distance will vary depending on the outrigger configuration of the crane. For example, the maximum horizontal working distance will be greater in instances where the outrigger between the load and the crane is fully extended as compared to when it is not extended.

In other embodiments, the load on the hook may be measured by the control system 300, and a maximum horizontal working distance is found based on the measured load. For example, rather than finding the maximum horizontal working distance for the highest load expected, the maximum horizontal working distance for the actual load is determined. This maximum horizontal working distance increases as the load on the hook is reduced. Thus the crane could be used to lift lighter loads farther from the crane, but still lift larger loads if they are near the crane. In one embodiment, the load on the hook may be measured by a load sensor. The load sensor may be operably coupled to the control system 300.

Whichever technique is used to determine the maximum horizontal working difference, the 3D surface will be dependent upon the determined maximum horizontal working distance. Furthermore, because the crane 10 may have an outrigger 16 configuration that is non-symmetrical, the maximum horizontal working distance may vary depending on the swing angle of the boom 12 on the crane 10. In FIG. 3, a first maximum horizontal working distance 20 is defined to the right side of the crane 10, while a second maximum horizontal working distance 22 is defined to the rear of the crane 10. Other cylindrical or partially cylindrical 3D surfaces would exist to the front and left hand side of the crane 10, but are not shown here for the sake of clarity. While this particular example would have four disjointed cylindrical or partially cylindrical 3D surfaces, it is possible for there to be more or less than four cylindrical or partially cylindrical 3D surfaces. In some embodiments, the maximum horizontal working distance may be determined dynamically dependent upon the swing angle.

Figure 4:
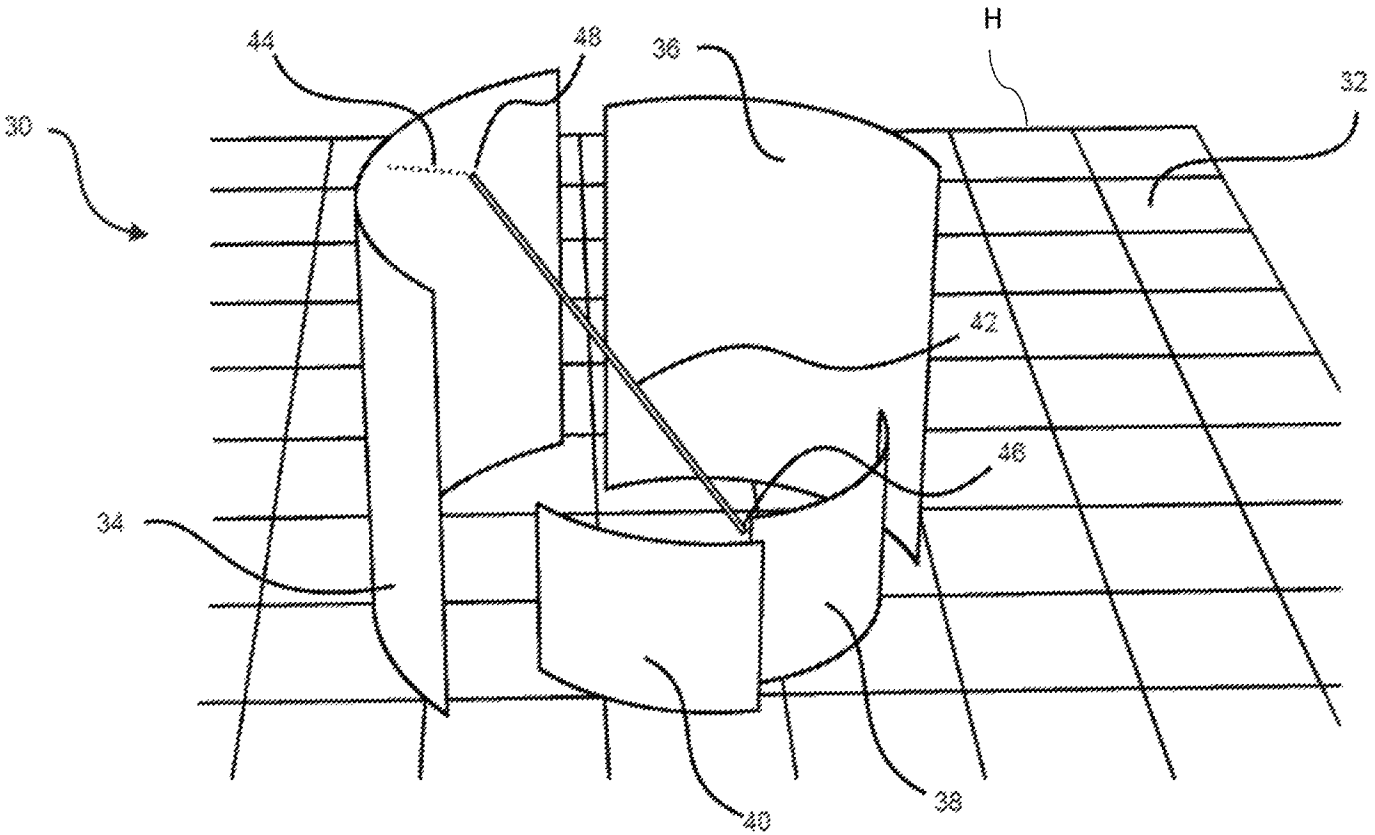
FIG. 4 illustrates a coordinate system having maximum horizontal working distance surfaces, a boom model, and a proximity vector according to an embodiment.

Referring to FIG. 4, in one embodiment, the computer system 300, in response to execution of the set of instructions 302 by the processor 308, is configured to generate a three dimensional ("3D") model having a representation 42 of the boom 12 and representations of the maximum horizontal working distance or distances in the form of one or more of the 3D surfaces 18 described above. In FIG. 4, four 3D surfaces 34, 36, 38, 40, are shown to represent the maximum horizontal working distance and different swing angles. The boom representation 42 and the 3D surfaces 34, 36, 38, 40, are oriented relative to one another in a 3D coordinate system 32.

In one embodiment, the boom representation 42 is generated based on sensor data from one or more boom sensors 52 (see FIG. 3) which indicate relative positioning of the boom portions, e.g., the base portion 13 and telescoping portions 14. For example, in one embodiment, the boom sensors 52 may measure positions of the boom portions 13 relative to the coordinate system 32. Alternatively or in addition, the boom sensors 52 may measure a length of extension of the boom 12. Boom sensors 52 may also measure a boom lift angle and a boom swing angle.

The maximum horizontal working distances may be positioned in the 3D model at locations relative to the vertical or rotational axis 'A' of the bed 8. In addition, the maximum horizontal working distances may be provided in the 3D model as the cylindrical section(s) or other 3D surfaces 18 described above. The cylindrical section(s) or other 3D surfaces 18 are generated by the control system 300 based load chart information which may be derived from, for example, the measured hook load or a desired or predicted hook load as well as an outrigger arrangement.

FIG. 4 illustrates an example of a 3D model 30 including the coordinate system 32, the 3D surfaces 34, 36, 38, 40 representing a maximum horizontal working distance, a boom segment 42 representing the crane boom 12, and a proximity vector 44. The 3D surfaces 34, 36, 38, 40, are defined using the techniques described above. The 3D surfaces may also be referred to herein as maximum horizontal working distance surfaces.

In one embodiment, the boom representation 42 is a line segment representing the physical orientation of the boom 12. The boom representation 42 has a first end 46 representing the base of the boom 12 and a second end 48 representing the tip of the boom 12. The orientation of the boom representation 42 may be determined based on the various sensors available to the crane 10, such as the boom sensors 52. For example, boom sensors 52 such as a swing angle sensor could determine the horizontal direction the boom representation 42 is pointing, a boom length sensor would determine the length of the boom representation 42, and a boom lift angle sensor may determine the angle of the boom representation relative to the horizontal plane H. Additionally, when loaded, the hook end of the boom 12 may deflect downward. The amount of deflection may be determined based on calculations of the RCL as known in the art. The deflection may be represented by another line segment at the second end of the boom segment 42, or it may be factored into the depiction of the boom, reducing the length and angle of the boom representation 42.

As shown in FIG. 4, the maximum horizontal working distance surfaces 34, 36, 38, 40 are defined relative to the same coordinate system defining the boom representation 42. The proximity vector 44 is the minimum vector between the maximum horizontal working distance surfaces 34, 36, 38, 40 and the boom representation 42. This vector 44 may be calculated based on the known coordinates of the boom representation 42 and the maximum horizontal working distance surfaces 34, 36, 38, 40. This vector 44 may be computed at discreet points, or calculated continuously.

The proximity vector 44 indicates how close the tip of the boom 12 is to the nearest maximum horizontal working distance surface (34 in FIG. 4) and also gives the direction of the minimum distance between the boom 12 and the nearest maximum horizontal working distance 34. That is, the vector 44 is configured to provide information relating to a distance and a direction in which the distance extends. The proximity vector 44 allows for relatively simple calculations to determine if a movement of the boom 12 would cause the hook to encounter the nearest maximum horizontal working distance. For example, the magnitude of the proximity vector 44 would approach zero as the boom 12 approached the nearest maximum horizontal working distance 34.

In some embodiments, the crane control system 300 may be configured to adjust sensitivity to operator input based on the magnitude of the proximity vector 44. As the proximity vector 44 approaches zero, the crane controls may slow to prevent the boom from encountering the nearest maximum horizontal working distance surface. For example, the crane control system 300 may control the boom 12 to reduce a speed of the boom 12 as the boom 12 approaches the nearest maximum horizontal working distance surface. In one embodiment, a speed at which the boom 12 swings (i.e., a rate of change of the swing angle) may be slowed as the boom 12 approaches an adjacent slew or swing sector having a lower maximum horizontal working distance. In another embodiment, a speed at which the boom 12 telescopes may be reduced as the boom 12 approaches the nearest maximum horizontal working distance surface. In still another embodiment, a speed at which the boom 12 is raised or lowered (i.e., a rate of change of the lift angle) may be slowed as the boom 12 approaches the maximum horizontal working distance surface.

It is understood that the control system 300 may control one or more of the crane functions above (e.g., boom telescope speed, boom swing speed, boom lift speed) in response to an indication, based on a proximity vector, that the boom 12 is approaching a maximum horizontal working distance surface. In addition to slowing the crane component, such as the boom 12, the control system 300 may alternatively, or in addition, stop movement of the crane component, such as the boom.

In one embodiment, a threshold vector magnitude may be provided at the control system 300. The threshold vector magnitude may be a maximum or minimum allowable proximity vector. For example, in one embodiment, the threshold vector magnitude is the minimum allowable proximity between the hook and the nearest maximum allowable working distance surface. In response to the distance between the hook and the maximum working distance surface being less than the threshold vector magnitude, the control system 300 is configured to change a crane function. The crane function may be, for example, the boom speed in one or more of the swinging, telescoping or lifting directions.

Alternatively, or in addition, a shutdown vector magnitude may be established at the control system 300. Thus, in response to the load on the hook being positioned relative to the maximum working distance at a distance less than the shutdown vector, the crane control system 300 may shut down a crane function, such as boom movement in a telescoping, swinging or lifting direction.

In some embodiments, the crane control system 300 may adjust sensitivity to controls in differing amounts. Because a crane 10 would be unlikely to encounter the nearest maximum horizontal working distance 34 when raising the boom 12 or retracting the boom 12, the crane control system 300 may reduce their respective sensitivity less than that of lowering the boom 12 or telescoping out, or may not adjust their sensitivity at all.

In some embodiments, the direction of the proximity vector 44 may be used in conjunction with the magnitude to selectively adjust the sensitivity of the operator input. For example, the reduction of the swing angle sensitivity may be dependent on a circumferential component of the proximity vector 44, the reduction of the boom angle sensitivity and the boom telescoping sensitivity may be dependent on the radial component on the proximity vector 44. These calculations are found in U.S. Provisional Patent Application 62/096,041 (CRANE 3D WORKSPACE SPATIAL TECHNIQUES FOR CRANE OPERATION IN PROXIMITY OF OBSTACLES), and subsequently filed U.S. patent application Ser. No. 14/974,812 having the same title, both of which are incorporated herein by reference in their entireties.

In examples such as the one depicted in FIG. 4, the proximity vector 44 may be calculated for a single maximum horizontal working distance surface. In some embodiments, such as the example shown in FIG. 5, the crane control system 300 may use multiple proximity vectors 44*a*, 44*b* to account for the disconnect between multiple maximum horizontal working distance surfaces 34, 36, 38, 40. For example, in some embodiments, a proximity vector may be provided to indicate a distance in a generally radial direction to the maximum horizontal working distance surface in a current working zone or slew sector, and another proximity vector may be provided to indicate a distance to an adjacent working zone or slew sector having a different maximum horizontal working distance, and the direction in which the adjacent working zone is positioned.

Figure 5:
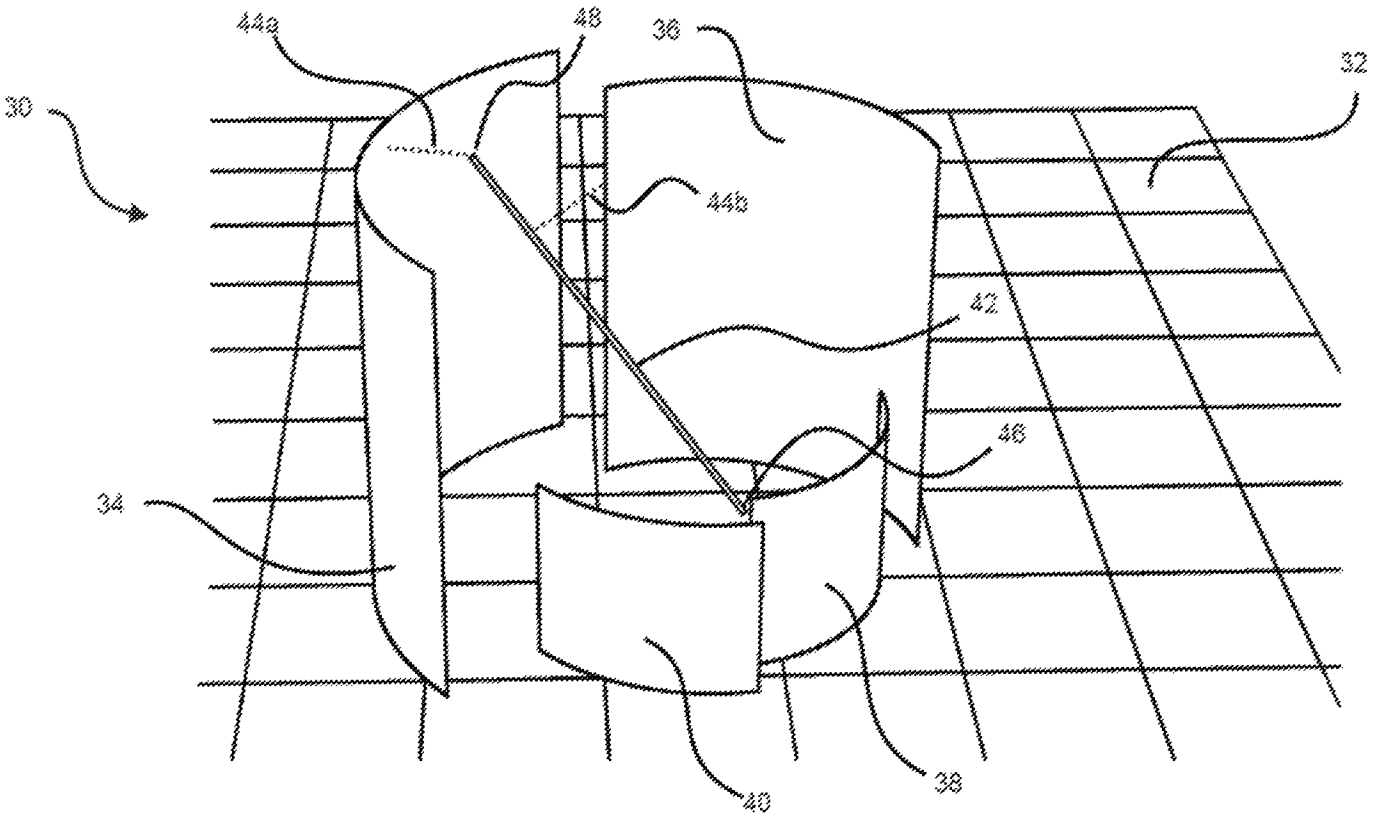
FIG. 5 illustrates a coordinate system having a maximum horizontal working distance surface, a boom model, and dual proximity vectors according to an embodiment.

FIG. 5 illustrates another 3D model of the crane boom 42 positioned relative to the maximum horizontal working distance surfaces 34, 36, 38, 40, but with multiple proximity vectors 44*a*, 44*b*. If the boom 12 were to swing clockwise as viewed from above, it would encounter a different maximum horizontal working distance surface 36, not accounted for in the first proximity vector 44*a*. Therefore, a second proximity vector 44*b* is used to affect the crane control system. With the addition of the second proximity vector 44*b*, the crane control system 300 may inhibit a clockwise swing movement until the boom were retracted such that it would no longer interfere with the different maximum horizontal working distance surface 36 when swung clockwise.

Figure 6:
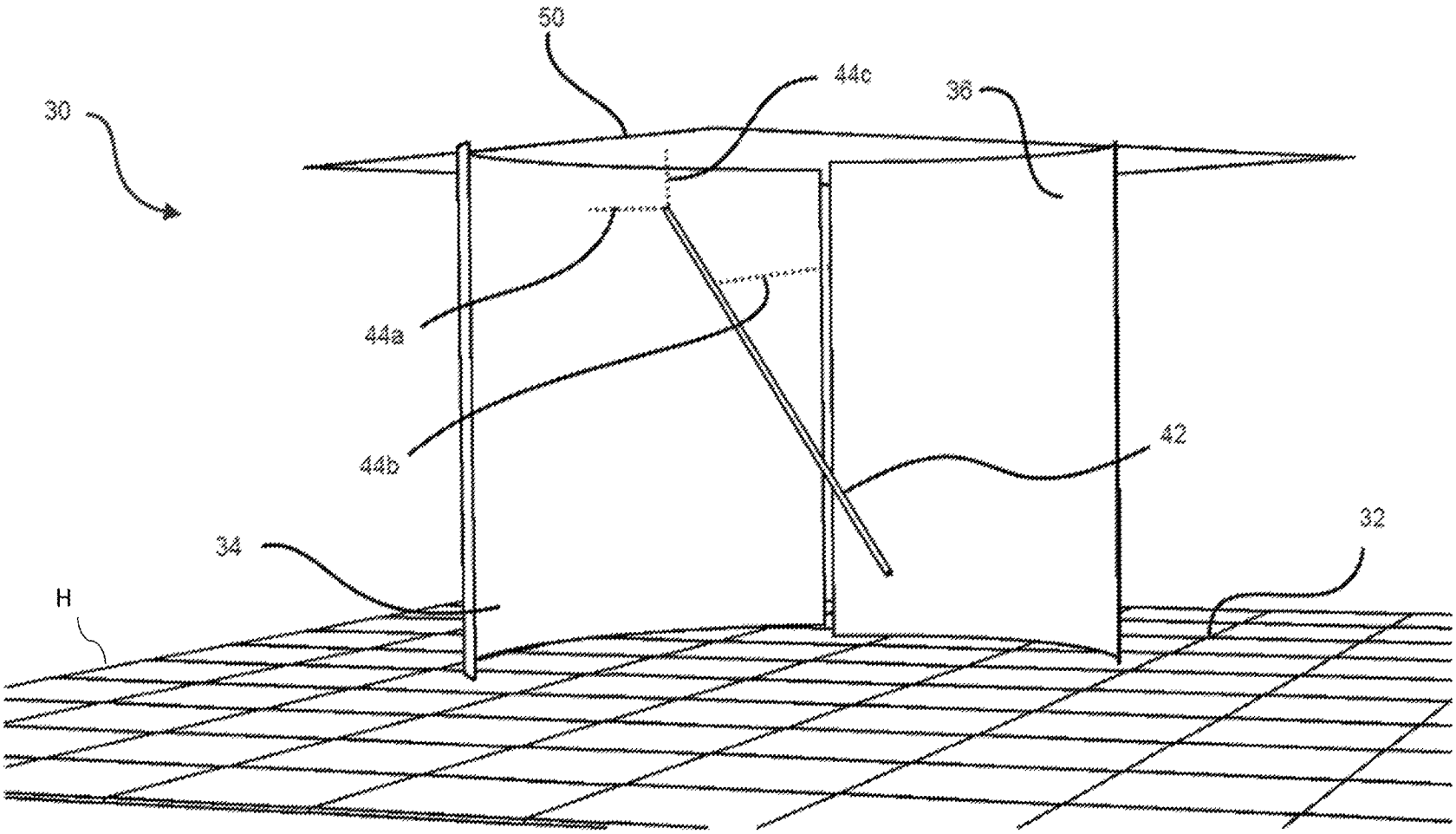
FIG. 6 illustrates the coordinate system of FIG. 5 with the boom model being moved to a new location and two updated proximity vectors according to an embodiment.

FIG. 6 illustrates another embodiment in which the maximum horizontal working distance surface 34, 36 is combined with a working range limiter (WRL). The functioning of a working range limiter is described in the aforementioned U.S. Provisional Patent Application 62/096,041 and U.S. patent application Ser. No. 14/974,812. With this combination, forbidden zones or obstacles are defined for the space around the crane. The forbidden zones or obstacles may be treated the same as the maximum horizontal working distance surface 34, 36 with the proximity vector pointing to the nearest of the forbidden zone and maximum horizontal working distance surface. A forbidden zone may be, for example, an area beyond the maximum horizontal working range. In addition, or alternatively, the load on a hook may be limited by boom stiffness as a boom lift angle increases. Thus, another forbidden zone may be near the crane corresponding to a relatively high lift angle and/or boom length. Another forbidden zone may be a volume substantially defining an obstacle, or plane defining, for example, a maximum lift height or a face of an obstacle, such as a building or other object at the worksite.

As shown in FIG. 6, a ceiling height restriction 50 is represented as a WRL forbidden zone and is treated as a 3D planar face (it can also be based on edges as well as the plane). Again, the proximity vectors 44*a*, 44*b*, 44*c* are calculated with respect to the planar face along with the cylindrical faces. The crane control system may then modify the movement of the boom in response to operator input. For example, in FIG. 6 the upward movement of the boom and the telescope out function may be inhibited based on the interaction with the ceiling height restriction. Similarly, the swing movement and telescope out controls may be modified to restrict the sensitively of the controls.

Accordingly, in the embodiments above a distance and direction to a maximum horizontal working distance surface (i.e., a 3D surface) may be determined and provided to the computing system 300 as a proximity vector. Calculations to determine whether a movement of the boom 12 may cause a hook to encounter the nearest maximum horizontal working distance surface may then be carried out based on the proximity vector. Subsequently, movement of the boom 12 may be controlled to avoid movement of the hook beyond a maximum horizontal working distance surface.

In addition, a calculation of the maximum horizontal working distance may be based on, for example, a position of each outrigger. In one embodiment, the outriggers may be arranged and extended non-symmetrically relative to one another. Thus, multiple maximum horizontal working distances corresponding to different swing angles or ranges of swing angles may be provided. That is, the maximum horizontal working distance may vary depending on a swing angle of the boom.

In the embodiments above, the crane control system 300 may output the generated 3D model to the display 370. For example, in one embodiment, the memory 304 or 315 may be operably connected to the processor 308 and store data representing a coordinate system, data representing the crane boom, data representing the maximum horizontal working distance, and computer executable instructions for execution by the processor 308. The computer executable instruction, when executed by the processor 308, is configured to generate the 3D model and output the 3D model to the display 370.

The 3D model may include, for example, a representation of the coordinate system 32 based on the data representing the coordinate system, a representation of boom 42 based on the data representing the crane boom, and a representation of the maximum horizontal working distance based on the data representing the maximum horizontal working distance. The representation of the maximum horizontal working distance may be shown as, for example, 3D surfaces 34, 36, 38, 40. In one embodiment, the 3D surfaces are in the form of cylindrical sections. The 3D model may also include the ceiling height restriction 50. Further still, one or more of vectors 44*a*, 44*b*, 44*c* may be shown in the displayed 3D model.

Thus, in some embodiments, the display 370 may display 3D models that generally include features shown in FIGS. 4-6, for example. In one embodiment, the 3D model may include a scaled depiction of the crane 10, crane boom 12 and/or other crane components, in place of the boom representation 42.

The display 370 may be mounted in an operator cab on the crane, a control panel on the crane remote from the operator cab, an offsite control center, or may be included on a portable electronic device, such as tablet or a laptop computer, that is operably and/or communicably coupled to the crane control system bus 320.

Accordingly, in the embodiments above, a 3D representation of the crane, crane boom or other crane components such as outriggers, working range limits or boundaries, and relative positions in a coordinate system of the above may be presented to an operator on the display 370. As such, the operator may be able to easily determine a position of crane at a worksite relative to other worksite objects and a working range limit of the crane for a particular load and crane configuration. The 3D model may be updated at predetermined intervals and output to the display 370 at predetermined intervals. In one embodiment, the predetermined intervals may be sufficiently short such that the display 370 is configured to show movement of the crane or other crane components in substantially real time. That is, 3D model may be a dynamic 3D model and the display 370 may display the dynamic model.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A method for controlling a boom of a crane, the method executable by a computing device having a processor and memory, comprising:

saving, in the memory, data representing a maximum horizontal working distance for a load on a hook of the boom, wherein the maximum horizontal working distance includes at least a first maximum horizontal working distance for a first angular range represented by a first cylindrical section extending through the first angular range and having a first radius which corresponds to the first maximum horizontal working distance and a second maximum horizontal working distance for a second angular range represented by a second cylindrical section extending through the second angular range and having a second radius which corresponds to the second maximum horizontal working distance;

saving, in the memory, boom data representing the position of the boom;

calculating a minimum vector between the position of the hook and the nearest of the first and second maximum horizontal working distances; and controlling, by the computing device, movement of the boom to prevent the vector from reaching a zero magnitude.

2. The method of claim 1, wherein saving data representing the maximum horizontal working distance comprises inputting data representing a load chart.

3. The method of claim 1, wherein the maximum horizontal working distance varies depending on a swing angle.

4. The method of claim 1, wherein saving data representing the maximum horizontal working distance comprises detecting a load on the hook and calculating the maximum horizontal working distance based on the detected load.

5. The method of claim 4, wherein calculating the maximum horizontal working distance comprises detecting a position of at least one outrigger and using the detected position to calculate the maximum horizontal working distance.

6. The method of claim 1, wherein the method further comprises:

saving, in memory, a forbidden zone near the crane;

calculating a second, minimum vector between the forbidden zone and the boom; and limiting, by the computing device, movement of the boom to prevent the second vector from reaching a zero magnitude.

7. The method of claim 1 wherein limiting movement of the boom comprises:

establishing a threshold vector magnitude; and changing a crane function responsive to the magnitude of the minimum vector between the hook and the maximum horizontal working distance being less than the threshold vector magnitude.

8. The method of claim 7, wherein changing the crane function comprises slowing down the movement of the boom in at least one direction that moves the hook closer to the maximum horizontal working distance.

9. The method of claim 7, wherein limiting movement of the boom further comprises:

establishing a shutdown threshold vector magnitude; and stopping movement of the boom in response to the magnitude of the shutdown vector between the hook and the maximum horizontal working distance being less than the threshold vector magnitude.

10. The method of claim 7, wherein the crane function is selected from the group consisting of telescoping in, telescoping out, booming up, booming down, swinging left, and swinging right.

11. A system for controlling a boom of a crane in proximity of obstacles at a worksite, comprising:

a crane control system configured to control operation of the crane boom;

a processor in operable communication with the crane control system; and memory in operable communication with the processor, the memory storing data comprising:

data representing a coordinate system;

data representing the crane boom;

data representing a maximum horizontal working distance wherein the maximum horizontal working distance includes at least a first maximum horizontal working distance for a first angular range represented by a first cylindrical section extending through the first angular range and having a first radius which corresponds to the first maximum horizontal working distance and a second maximum horizontal working distance for a second angular range represented by a second cylindrical section extending though the second angular range and having a second radius which corresponds to the second maximum horizontal working distance; and computer executable instructions for execution by the processor, the computer executable instruction configured to calculate a minimum vector between the crane boom and the nearest of the first and second maximum horizontal working distances based on the data representing the crane boom and the data representing the maximum horizontal working distance, wherein the minimum vector includes a distance and a direction to the nearest of the first and second maximum horizontal working distances, and to cause the crane control system to limit movement of the boom based on the calculated minimum distance.

12. The system of claim 11, wherein the data representing the maximum horizontal working distance is dependent on a swing angle.

13. The system of claim 11 further comprising a load sensor configured to measure a load on the crane boom, wherein the data representing a maximum horizontal working distance is dependent on a measured load on the hook.

14. The system of claim 13, further comprising an outrigger length monitor configured to detect an outrigger length, wherein the detected outrigger length is used to calculate the maximum horizontal working distance.

15. A crane control system of a crane having a boom, the system comprising:

a processor;

a display operably coupled to the processor; and a memory in operable communication with the processor, the memory storing data comprising:

data representing a coordinate system;

data representing the crane boom based on one or more sensor measurements of the boom;

data representing a maximum horizontal working distance; and computer executable instructions for execution by the processor, the computer executable instructions configured to generate a three-dimensional model comprising:

a representation of the coordinate system based on the data representing the coordinate system;

a representation of the crane boom based on the data representing the crane boom; and a representation of the maximum horizontal working distance based on the data representing the maximum horizontal working distance, wherein the representation of the maximum horizontal working distance includes at least a representation of a first maximum horizontal working distance for a first angular range and a representation of a second maximum horizontal working distance for a second angular range, wherein the representation of the first maximum horizontal working distance includes a first cylindrical section extending through the first angular range and having a first radius which corresponds to the first maximum horizontal working distance, and the representation of the second maximum horizontal working distance includes a second cylindrical section extending through the second angular range and having a second radius which corresponds to the second maximum horizontal working distance, wherein the three-dimensional model is displayed on the display.

16. The crane control system of claim 15, wherein the representation of the crane boom is a line segment.

17. The crane control system of claim 15, wherein the memory further stores data representing a proximity vector between the crane boom and the maximum horizontal working distance and the three-dimensional model comprises a representation of the proximity vector based on the data representing the proximity vector, wherein the representation of the proximity vector extends between the representation of the crane boom and at least one of the representations of the first and second maximum horizontal working distances.

18. The crane control system of claim 17, wherein the representation of the proximity vector indicates a minimum distance and a direction of the minimum distance between the crane boom and at least one of the first and second maximum horizontal working distances.

19. The crane control system of claim 17, wherein the representation of the proximity vector includes a representation of a first proximity vector and a representation of a second proximity vector, wherein the representation of the first proximity vector extends between the representation of the crane boom and the representation of the first maximum horizontal working distance, and the representation of the second proximity vector extends between the representation of the crane boom and the representation of the second maximum horizontal working distance.

20. The crane control system of claim 15, further comprising a controller configured to control movements of the crane boom based on a proximity vector between the crane boom and a nearest of the first and second maximum horizontal working distances.

* * * * *